US012740659B2

(12) United States Patent
Massaquoi

(10) Patent No.: US 12,740,659 B2
(45) Date of Patent: Sep. 22, 2026

(54) SYSTEM AND METHOD FOR MANUFACTURING AN ERGONOMIC PILLOW WITH ADJUSTABLE SUPPORT

(71) Applicant: Feikamoh Ahmed Massaquoi, Missouri City, TX (US)

(72) Inventor: Feikamoh Ahmed Massaquoi, Missouri City, TX (US)

(73) Assignee: Feikamoh Ahmed Massaquoi, Missouri City, TX (US)

( * ) Notice: Subject to any disclaimer, the term of this patent is extended or adjusted under 35 U.S.C. 154(b) by 195 days.

(21) Appl. No.: 18/544,867

(22) Filed: Dec. 19, 2023

(65) Prior Publication Data

US 2025/0194827 A1 Jun. 19, 2025

Related U.S. Application Data

(60) Provisional application No. 63/476,271, filed on Dec. 20, 2022.

(51) Int. Cl.
*A47G 9/10* (2006.01)

(52) U.S. Cl.
CPC ..... *A47G 9/10* (2013.01)

(58) Field of Classification Search
CPC ..... B68G 7/06
See application file for complete search history.

(56) References Cited

U.S. PATENT DOCUMENTS 4,664,160 A * 5/1987 Rothstein ..... B68G 7/06 406/173
5,199,244 A * 4/1993 Beier ..... B68G 7/06 53/111 R
6,235,391 B1 * 5/2001 Contreras ..... B68G 1/00 428/377
6,860,092 B2 * 3/2005 Collida ..... A63H 9/00 53/527
2007/0180622 A1 * 8/2007 Zito ..... A47G 9/1045 5/639

(Continued)

FOREIGN PATENT DOCUMENTS

CN 111012129 A * 4/2020 ..... B68G 7/08
CN 118542558 A * 8/2024 ..... B68G 1/00

(Continued)

OTHER PUBLICATIONS

"Marking Tools for Quilt Projects (Ep. 105)", Mar. 10, 2016, https://www.youtube.com/watch?v=kzBj5BAmHbs.*

(Continued)

*Primary Examiner* — Eric J Kurilla

(74) *Attorney, Agent, or Firm* — Ashurst Perkins Coie US LLP

(57) ABSTRACT

The present invention pertains to an adjustable support pillow. The pillow features a foldable design, allowing users to customize the adjustable support pillow's shape for optimal comfort and support. The pillow is constructed from a pair of sewn fabric sheets pockets are created by the joining of the fabric sheets. The filling material, comprising shredded particles, is introduced into these pockets through a controlled process, ensuring uniform distribution within each pocket. The foldable nature of the pillow enables versatile configurations, addressing various user preferences.

13 Claims, 13 Drawing Sheets

(56) References Cited

U.S. PATENT DOCUMENTS

2013/0291801 A1* 11/2013 Throndsen ..... A01K 1/0157
119/28.5

FOREIGN PATENT DOCUMENTS

| | | | | | |
|---|---|---|---|---|---|
| DE | 3335182 | C2 | * | 12/1989 | ..... B68G 7/06 |
| KR | 200400809 | Y1 | * | 11/2005 | ..... A47G 9/007 |
| KR | 20170000161 | U | * | 1/2017 | ..... A47G 9/10 |
| KR | 20190043298 | A | * | 4/2019 | ..... B68G 7/08 |
| KR | 20230044625 | A | * | 4/2023 | ..... B68G 11/04 |
| KR | 20240053297 | A | * | 4/2024 | ..... B68G 7/06 |

OTHER PUBLICATIONS

ISO-4915, "Textiles—Stich Types—Classification and Terminology" (Year: 1991).*

* cited by examiner

SYSTEM AND METHOD FOR MANUFACTURING AN ERGONOMIC PILLOW WITH ADJUSTABLE SUPPORT

CROSS-REFERENCE TO RELATED APPLICATIONS

This patent document claims the benefit of priority to U.S. Patent Application No. 63/476,271, filed Dec. 20, 2022. The entire contents of the above noted provisional application is incorporated by reference as part of the disclosure of this document.

TECHNICAL FIELD

The present invention relates to the field of sleep accessories and comfort products, and more particularly to a pillow device and method of manufacturing.

BACKGROUND

Sleep quality and overall well-being are intricately linked, with pillows playing a pivotal role in ensuring a restful and comfortable night's sleep. Beyond their traditional association with nighttime rest, pillows play a crucial role in enhancing relaxation during leisure activities such as reading, watching TV, or engaging in various forms of recreation. Moreover, pillows have become indispensable in the realm of healthcare, offering therapeutic benefits by providing targeted support to individuals recovering from injuries or managing specific medical conditions.

Pillow manufacturing has predominantly featured conventional designs characterized by standardized shapes and fixed support structures. However, one of the drawbacks of the conventionally designed fixed-structure pillows is their limited adaptability. Users with varying sleep preferences and postures find it challenging to discover a one-size-fits-all solution. The inherent inflexibility of these traditional designs results in discomfort, as users are forced to conform to the pillow's predetermined shape and support level. These conventional pillows lack the adaptability and customizable features required to address the diverse needs of users. Moreover, the lack of customization in prior art pillows often leads to inadequate neck and head support, resulting in discomfort and even contributing to issues like neck pain or tension. Users with specific sleep preferences or those seeking personalized comfort during different activities, such as reading or watching TV, are left underserved by these fixed-structure pillows.

SUMMARY

Methods and systems for ergonomic pillows with adjustable support are disclosed. In some embodiments, a cutting element precisely cuts fabric into a first rectangular fabric sheet and a second rectangular fabric sheet. An erasable marker is used to mark multiple first and second longitudinal marks on the first rectangular fabric sheet. A movable mechanical device places the first sheet on the second sheet. A sewing device forms multiple pockets within the sheets along the marked longitudinal lines. A filling system, including a PVC pipe, funnel, electric mill grinder, and dowel, inserts filling material into the pockets. The sewing device then ensures full enclosure of the filling material within each pocket along a new bottommost unenclosed second longitudinal mark. A washing component removes the marked lines from the first fabric sheet.

In some embodiments, the filling material for the foldable adjustable support pillow includes shredded memory foam, cork, cotton, latex, down, polyester fiberfill, or microbeads of polyfoam. In some embodiments, the first and second rectangular fabric sheets are made of a moisture-wicking material, preventing the accumulation of moisture. In some embodiments, the first and second rectangular fabric sheets are made of cotton, polyester, linen, bamboo, silk, microfiber, satin, nylon, spandex, a nylon/spandex blend, and/or polyester including nylon and spandex. In some embodiments, the first and second rectangular fabric sheets are folded into a U-shape. In some embodiments, filling material is processed using a grinder to transform the filling material into particles suitable for filling each pocket. In some embodiments, an outer layer, configured to enclose the first and second rectangular fabric sheets, is made of a cooling and elastic material.

The system, in some embodiments, reduces greenhouse emissions compared to manufacturing a cushion using polyurethane foam, thereby providing an environmentally friendly approach to pillow production. The cutting apparatus, in some embodiments, is equipped with computerized controls for precise and automated cutting of the first and second rectangular fabric sheets, ensuring accuracy and efficiency in the manufacturing process. The washing component, in some embodiments, includes a water-based cleaning solution for the removal of multiple first and second longitudinal marks. This water-based solution, utilizing water as a primary solvent, dissolves the marks, contributing to the overall cleanliness of the fabric sheets. The system, in some embodiments, includes a quality control sensor system designed to detect and alert in case of any deviation during sewing along the multiple first and second longitudinal marks, ensuring high-quality production standards. The sewing device, in some embodiments, is a computerized sewing machine programmed to follow a grid pattern defined by the multiple first and second longitudinal marks, resulting in precise and consistent pocket formation. The movable mechanical device, in some embodiments, is a robotic arm providing accurate and repeatable placement of the first rectangular fabric sheet onto the second rectangular fabric sheet, ensuring consistency in the manufacturing process.

In some embodiments, the pair of fabric sheets are cut using a cutting apparatus equipped with computerized controls for precise and automated cutting. The sewing device, in some embodiments, employs an overlock stitch for enhanced seam durability. The filling system, in some embodiments, includes a weighing mechanism to ensure accurate and consistent filling of each pocket with the filling material. The pockets, in some embodiments, are configured in a grid, rounded, or triangular shape. The fabric sheets, in some embodiments, are made of cotton, polyester, linen, bamboo, silk, microfiber, satin, nylon, spandex, a nylon/spandex blend, and/or polyester including nylon and spandex. The filling material, in some embodiments, includes shredded memory foam, cork, cotton, latex, down, polyester fiberfill, or microbeads of polyfoam.

DETAILED DESCRIPTION

While the present ergonomic pillow is described in detail for use with sleeping positions, the ergonomic pillow could be applied, with appropriate modifications, to improve various other applications and contexts beyond the explicitly mentioned foldable adjustable support pillow. These applications could span a wide range of uses, including but not limited to other types of cushions, seating arrangements, furniture components, or medical devices requiring adjustable support. The examples provided in this paragraph are intended as illustrative and are not limiting. Any application referenced in this document, and many others unmentioned are equally appropriate after appropriate modifications.

The invention is implemented in numerous ways, including as a process; an apparatus; a system; a composition of matter; a computer program product embodied on a computer-readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description that references the accompanying figures follows. The scope of the invention is limited only by the claims and the invention encompasses numerous alternatives, modifications, and equivalents. Numerous specific details are set forth in the following description in order to provide a thorough understanding of the disclosure. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Figure 1:
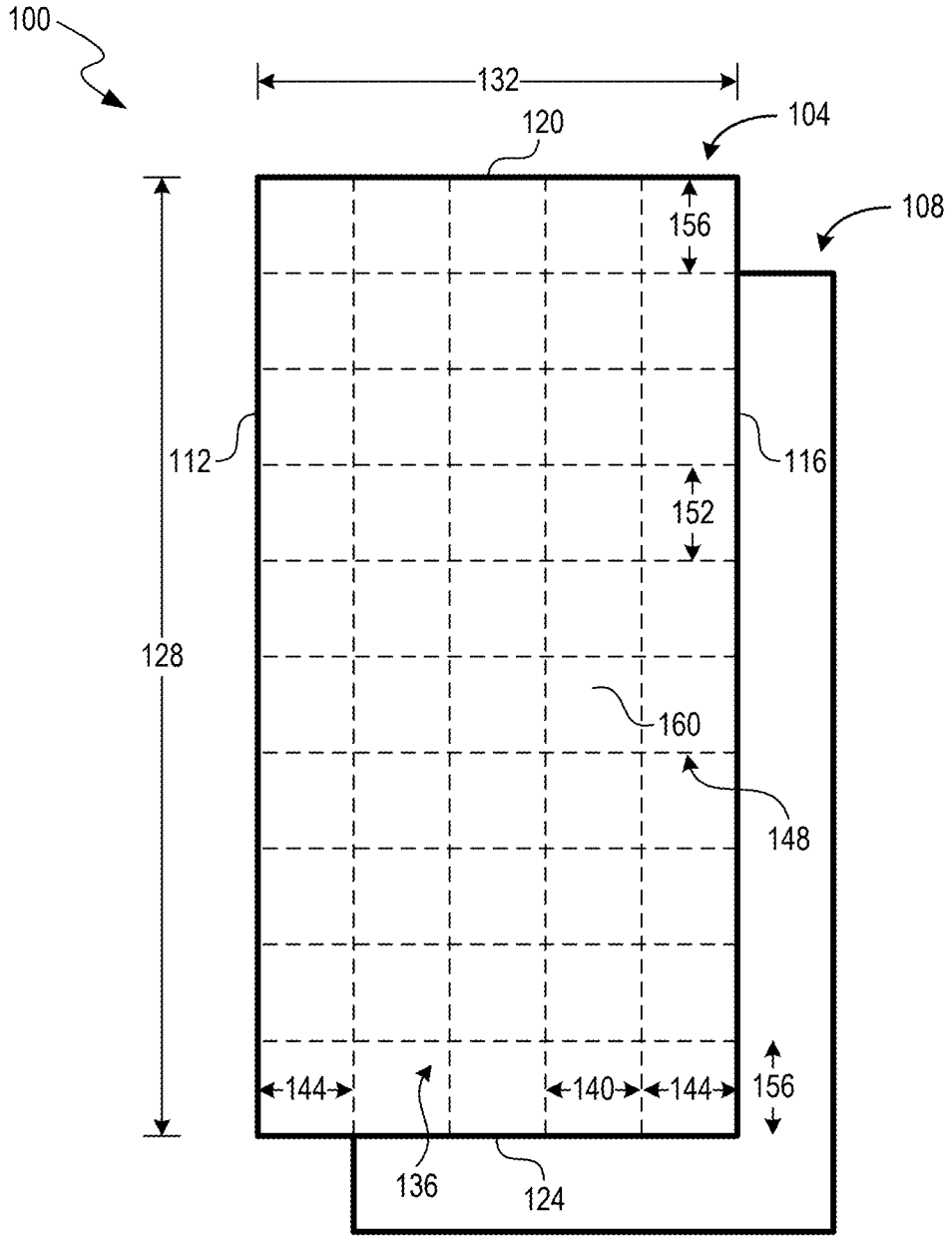
FIG. 1 is a drawing illustrating a layered view of an ergonomic pillow with adjustable support, in accordance with one or more embodiments.

FIG. 1 is a drawing illustrating a layered view of an ergonomic pillow 100 with adjustable support, in accordance with one or more embodiments.

The ergonomic pillow 100 includes two primary fabric sheets, the first fabric sheet 104 and the second fabric sheet 108. In some embodiments, either the first fabric sheet 104 or the second fabric sheet 108 is made of moisture-wicking material, designed to prevent the accumulation of moisture and enhance the overall comfort and hygiene of the ergonomic pillow. The moisture-wicking material of the first fabric sheet 104 and the second fabric sheet 108 actively draw away perspiration or dampness, maintaining a dry and comfortable sleep environment.

In some embodiments, either the first rectangular fabric sheet 104 or the second rectangular fabric sheet 108 is crafted from cotton, polyester, linen, bamboo, silk, microfiber, satin, nylon, spandex, a nylon/spandex blend, and/or polyester including nylon and spandex. The selection of materials for the first rectangular fabric sheet 104 or the second rectangular fabric sheet 108, in some embodiments, depends upon specific functional requirements. For example, in some embodiments, cotton offers a breathable and soft feel, linen could provide durability, and microfiber might contribute to a smoother texture.

The first fabric sheet 104 and the second fabric sheet 108 are shaped by the first side 112, third side 116, second side 120, and fourth side 124, which encloses each respective fabric sheet. The first side 112 and the third side 116 have a length 128. The second side 120 and the fourth side 124 have a width 132. In one embodiment, the first fabric sheet 104 comprises straight lines, defined by the first side 112, third side 116, second side 120, and fourth side 124. In another embodiment, the first fabric sheet 104 follows a non-straight or contoured design. In some embodiments, the sides—first side 112, third side 116, second side 120, and fourth side 124—exhibit curves or irregular shapes. In some embodiments, the shapes of the four sides are further customized to meet specific user preferences or ergonomic needs. For example, the curves along the first side 112 and third side 116 are subtle, offering a gentle contouring effect, or pronounced, providing enhanced support in targeted areas.

On the first fabric sheet 104, lines are marked. In some embodiments, the lines are marked with a washable marker. The first lines 136 are drawn from the second side 120 to the fourth side 124. The first lines 136 are spaced out equidistantly by a first line distance 140, except the first and last line of the first lines 136 closest to the first side 112 and the third side 116 respectively. The first and last lines of the first lines 136 are spaced by a first edge distance 144. Similarly, the second lines 148 are drawn, except from the second side 120 and the fourth side 124. The second lines 148 are spaced out equidistantly by a second line distance 152, except the first and last line of the second lines 148 closest to the second side 120 and the fourth side 124 respectively. The first and last line of the second lines 148 are spaced by a second edge distance 156.

The first lines 136 and the second lines 148 create a systematic pattern that facilitates the formation of distinct pockets 160 that are created via sewing the first lines 136 and the second lines 148 within the ergonomic pillow. In some embodiments, the sewing device uses reinforced stitching along stress points, such as corners and pocket 160 intersections, to ensure that the stress points withstand future tension. In some embodiments, the pillow lining formed by the sewing device is made of any of: 1) polyester 2) polyester and latex 3) polyester with additional special cooling technology materials, or any other suitable material having cooling features, following pillow protection required by pillow label law properties. It is important to note that a pillow lining may or may not be included in the final outcome of the disclosure, which will primarily depend on the pillow laws and regulations and the pillow lining's absolute need.

In some embodiments, a "triple zigzag" stitch pattern is employed during the sewing process, which involves three closely spaced zigzag stitches worked in tandem. Unlike a regular zigzag stitch, which consists of a single zigzag pattern, the triple zigzag stitch incorporates three parallel zigzag lines in quick succession. Thus, the three parallel lines of the triple zigzag stitch, in some embodiments, create a reinforced and secure seam. In some embodiments, the triple zigzag pattern accommodates the inherent stretchiness of elastic fabrics (e.g., such as a nylon/spandex blend). The triple zigzag stitch provides enhanced flexibility, allowing the stitches to expand and contract with the fabric when subjected to stretching. The approach ensures that the structural integrity of the stitches is maintained even during dynamic movements or stretching of the material. The triple zigzag stitch, in some embodiments, lengthens the overall longevity or performance of the adjustable support pillow.

The pockets 160 are configured in a structured arrangement suitable for accommodating filling material. In some embodiments, the systematic arrangement of the pockets 160 is adaptable, allowing for different configurations in various embodiments. As described in further detail below, in some embodiments, the pockets 160 are triangular or rounded. In some embodiments, the systematic pattern enhances the overall integrity of the pillow and also ensures an even distribution of the filling material throughout the pockets 160 to provide adjustable support. In some embodiments, the pockets 160 created along the first and last lines of the first lines 136 and second lines 148 are smaller or larger than the other pockets 160. In some embodiments, the pockets are not of uniform size within the adjustable support pillow. Rather, by adjusting the spacing and width of the grid lines, pockets of varying sizes are made.

Figure 2:
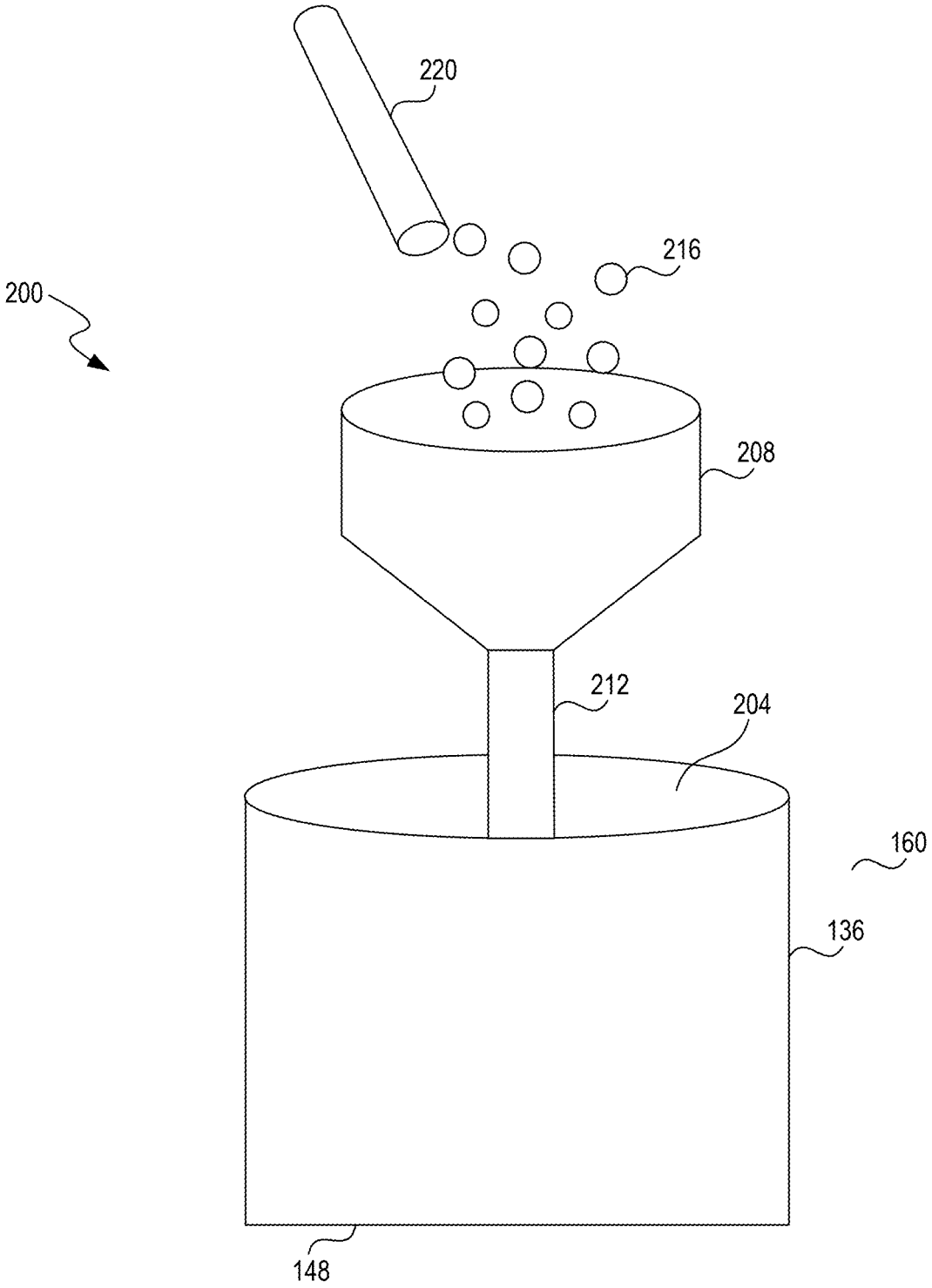
FIG. 2 is a drawing illustrating a method of creating the filling material.

FIG. 2 is a drawing illustrating a method 200 of creating the filling material. The pockets 160, in some embodiments, have an interior 204 configured for the insertion of the chosen material. Pockets 160 are defined by their first lines 136 and second lines 148, with these dimensions providing a structure for the accommodation of the chosen material. In some embodiments, the funnel 208 is securely attached to a PVC pipe 212, forming a conduit for the filling material 216. The PVC pipe 212, serving as a channel, leads into the interior 204 of each of the pockets 160 within the ergonomic pillow.

Method 200 utilizes a dowel 220, in some embodiments, as a tool for the controlled insertion of filling material 216 into a funnel 208. In some embodiments, dowel 220 is a wooden dowel. In some embodiments, dowel 220 is any tool that is configured for pushing filling material 216 into funnel 208. The dowel 220 acts as a tool to exert controlled pressure, guiding the filling material 216 through the funnel 208 and PVC pipe 212. The method 200 ensures a uniform insertion of filling material 216 into the pillow. In some embodiments, the amount of filling material 216 inserted varies based on the dimensions of the pillow.

The filling material 216, in some embodiments, includes shredded memory foam, cork, cotton, latex, down, polyester fiberfill, or microbeads of polyfoam. In some embodiments, the filling material 216 is a combination of at least two different materials. In some embodiments, the filling material 216 for each of the pockets 160 are not uniform. In some embodiments, the filling material 216 is ground natural cork. In some embodiments, the filling material 216 is a blend of ground natural cork and ground natural latex.

In some embodiments, the filling material 216 includes a ratio that is approximately one part cork to two parts latex. The texture of the cork, in some embodiments offsets the inherent bounce of elastic materials such as latex, since the cork provides a touch of rigidity. The filling material 216, in some embodiments, comfortably cradles objects on the surface. In some embodiments, the filling material 216 has moisture-resistant properties (e.g., natural cork, natural latex).

In some embodiments, the dowel's 220 configuration, such as the dowel's 220 material, length, or diameter, is varied based upon the density, amount, or texture of the filling material. For example, alternative materials, such as metals or composite materials, are used as the filling material 216. Additionally, in another example, varying the dowel's 220 diameter or tapering the dowel's 220 shape allows for different insertion pressures. Moreover, in some embodiments, automated systems are used to control the insertion of filling material 216 into the pockets 160.

Figure 3:
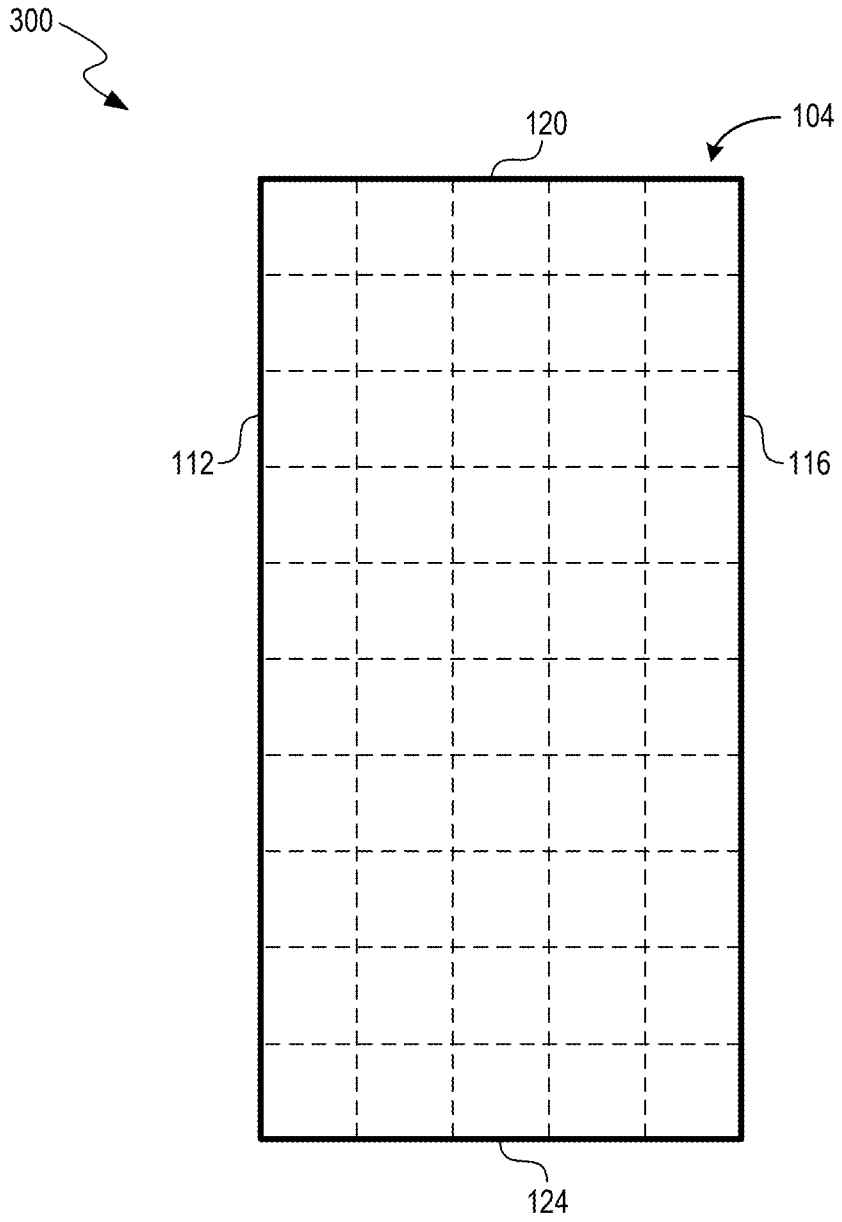
FIG. 3 is a drawing illustrating a top view of an ergonomic pillow with adjustable support, in accordance with one or more embodiments.

FIG. 3 is a drawing illustrating a top view of an ergonomic pillow 300 with adjustable support, in accordance with one or more embodiments. The first fabric sheet 104 is defined by the first side 112, second side 120, third side 116, and fourth side 124, where the first side 112 and third side 116 define the first fabric sheet's 104 length and second side 120 and the fourth side 124 define the first fabric sheet's 104 width. In some embodiments, the first fabric sheet 104 and/or second fabric sheet 108 are temperature-regulating fabrics or moisture-wicking blends to adapt to the user's needs.

In some embodiments, the first fabric sheet 104 is arranged atop the second fabric sheet 108, creating a layered construction of the ergonomic pillow 300. The first fabric sheet 104, cut to specific dimensions and shaped accordingly, aligns with precision over the second fabric sheet 108. The layering mechanism allows for the subsequent steps of the manufacturing process, such as sewing and forming pockets 160, thus contributing to the overall design and functionality of the adjustable support pillow. In some embodiments, there is a further layering mechanism that comprises adjustable inserts or layers within the pillow's structure allowing users to fine-tune the firmness according to personal preferences.

Figure 4:
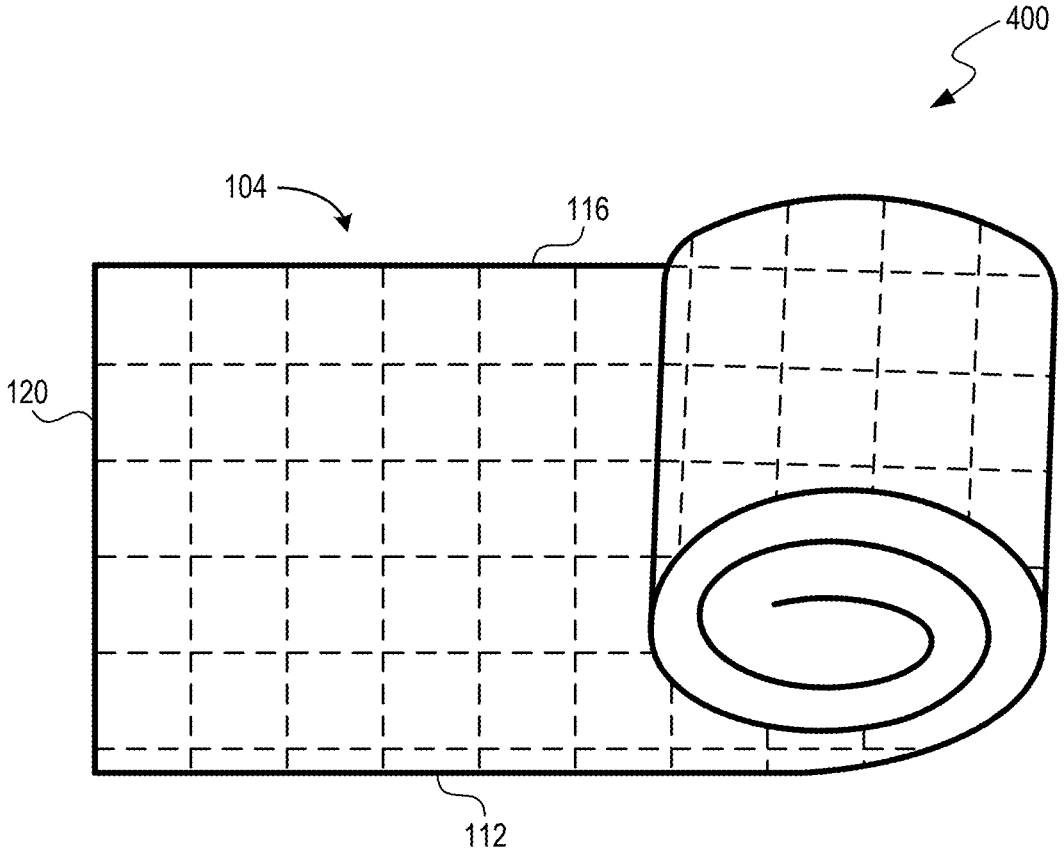
FIG. 4 is a drawing illustrating a side view of an ergonomic pillow with adjustable support in a folded configuration, in accordance with one or more embodiments.

FIG. 4 is a drawing illustrating a side view of an ergonomic pillow with adjustable support in a folded configuration 400, in accordance with one or more embodiments. The first fabric sheet 104 and the second fabric sheet 108, characterized by the first fabric sheet's 104 first side 112, third side 116, second side 120, and fourth side 124, are designed to allow for easy folding or rolling, enhancing the portability and convenience of the pillow. In some embodiments, the second fabric sheet 108 is placed under the first fabric sheet 104 so that the edges of the first fabric sheet 104 and the second fabric sheet 108 correspond. The edges of the first fabric sheet 104 and the second fabric sheet 108, comprising the first side 112, third side 116, second side 120, and fourth side 124, are configured to ensure that the folded pillow maintains the pillow's desired shape. In some embodiments, the edges have thicker fabric material to maintain more rigidity.

As the first fabric sheet 104 is folded up and rolled, the first lines 136 and second lines 148 of the pockets 160 delineated by the grid lines (as described in FIG. 1) remain intact. The preservation of the pocket 160 structure maintains the distribution of the filling material within the folded configuration. In some embodiments, the folded configuration 400 is folded in a shape that provides more ergonomic support for the user than the unfolded configuration. In some embodiments, the adjustable support pillow is rolled along the first side 112 and the third side 116 or the second side 120 and the fourth side 124 to create the folded configuration 400. In some embodiments, the folded configuration 400 provides users with a portable and easily storable support solution.

In some embodiments, the folded configuration 400 is in a different shape besides rolling the pillow along the first side 112 and the third side 116 or the second side 120 and the fourth side 124, such as a U-shaped configuration. In some embodiments, the folded configuration 400 is an accordion fold, where the pillow is folded in a zigzag pattern resembling an accordion to allow users to adjust the height and support levels by controlling the number of folds. In another example, the folded configuration 400 is a triangular fold, where the pillow is folded into a triangular shape, offering a different ergonomic support structure when compared to the traditional rectangular form and providing targeted support to specific areas.

In some embodiments, the adjustable support pillow incorporates magnetic or hook-and-loop fasteners. Embedded magnets along the seams allow for a secure yet easily adjustable connection, enabling users to modify the pillow's shape or configuration with minimal effort. On the other hand, placing hook-and-loop fasteners along the seams allows users to customize the firmness or adjust the arrangement of the pockets.

Furthermore, in some embodiments, the thickness and composition of the edges vary. Some embodiments use thicker edges for added structural support, while others opt for thinner edges to enhance the overall flexibility of the folded configuration.

Figure 5:
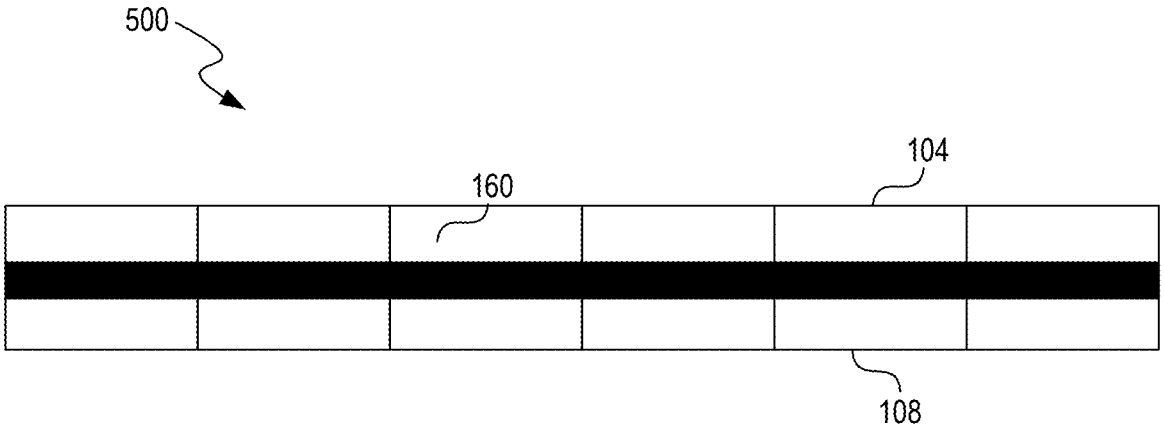
FIG. 5 is a drawing illustrating a cross-sectional view of an ergonomic pillow with adjustable support, in accordance with one or more embodiments.

FIG. 5 is a drawing illustrating a cross-sectional view 500 of an ergonomic pillow with adjustable support, in accordance with one or more embodiments. FIG. 5 depicts the space between the first fabric sheet 104 and the second fabric sheet 108, where the filling material 216 resides within the pockets 160.

The filling material 216 is uniformly distributed within the pockets 160. In some embodiments, the pockets 160, formed by the grid lines discussed above, maintain a systematic arrangement that prevents uneven settling of the filling material 216. The even distribution of the filling material 216 across the length and width of the pillow ensures that the support is consistent with the user's needs so that the parts of the pillow provide consistent support.

In some embodiments, there is a weighing mechanism integrated into the system, to guarantee accuracy and consistency in the filling process. The weighing mechanism is designed to measure and monitor the amount of filling material 216 deposited into each pocket, thereby ensuring uniformity across the entirety of the pillow. The weighing mechanism feature not only addresses the potential challenges associated with manual filling but also provides users with a pillow that consistently delivers the same amount of support (e.g., provided by filling material 216).

Manufacturing cushions utilizing polyurethane foam as the filling material 216 entails significant environmental drawbacks rooted in the petrochemical industry. Polyurethane foam is predominantly derived from crude oil, a non-renewable resource. The extraction, refinement, and processing of crude oil involve resource-intensive procedures that contribute to environmental degradation and further reliance on finite fossil fuel reserves. Manufacturing cushions utilizing polyurethane foam as the filling material 216 exacerbates concerns related to climate change, energy sustainability, and overall ecological impact.

In addition to polyurethane foam's reliance on non-renewable resources, the production of polyurethane foam involves chemical processes that release volatile organic compounds (VOCs) into the atmosphere. VOCs, such as toluene and methylene chloride, are known air pollutants that can have adverse effects on air quality. Exposure to VOCs emitted during the manufacturing of polyurethane foam can lead to respiratory issues, irritation of the eyes and throat, and potential long-term health risks. Therefore, the environmental and health impacts associated with the production and use of polyurethane foam warrant careful consideration.

Furthermore, the reliance on polyurethane foam perpetuates the carbon footprint associated with the petroleum industry. The disposal of polyurethane foam cushions poses challenges. The material does not readily biodegrade, contributing to environmental waste concerns and the burden on landfill sites. By opting for alternative materials and methods, such as the approach outlined in some embodiments listed, there is an opportunity to reduce reliance on petrochemicals, mitigate environmental impact, and contribute to sustainable practices. The implementations described herein therefore reduce greenhouse gas emissions and mitigate the effects of climate change.

Figure 6:
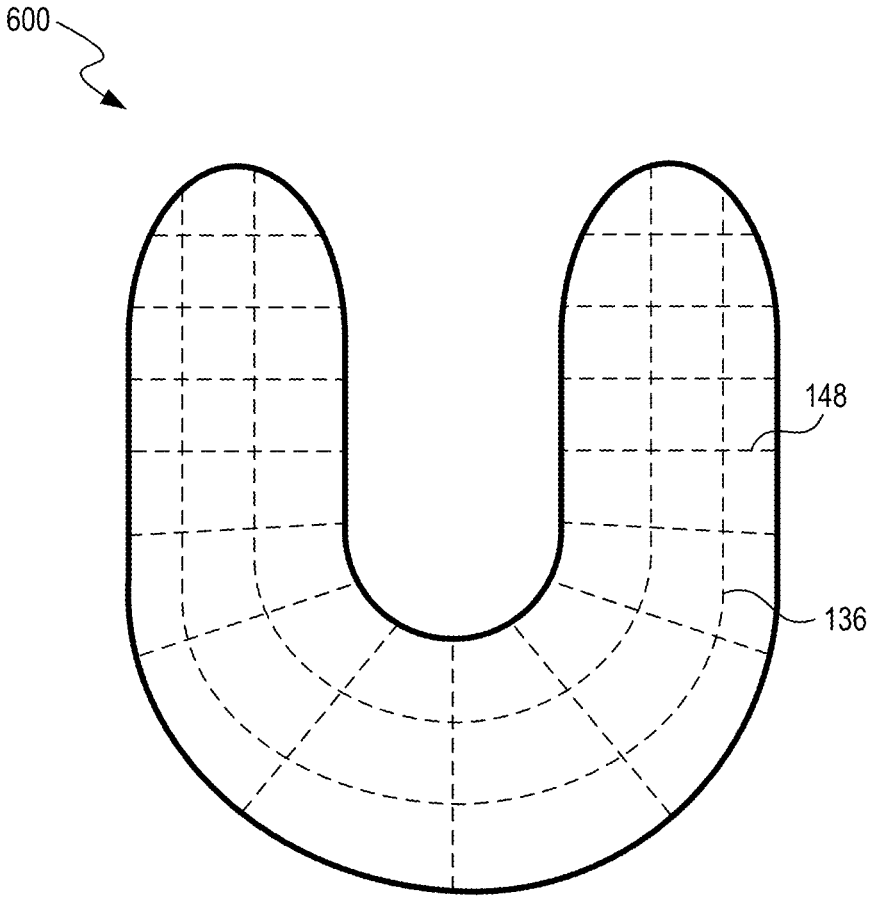
FIG. 6 is a drawing illustrating a side view of an ergonomic pillow with adjustable support in a folded U-shaped configuration, in accordance with one or more embodiments.

FIG. 6 is a drawing illustrating a side view of an ergonomic pillow with adjustable support in a folded U-shaped configuration 600, in accordance with one or more embodiments. The first fabric sheet 104 and the second fabric sheet 108, both characterized by their sides (first side 112, second side 120, third side 116, and fourth side 124), in some embodiments, are configured to facilitate the folding of the ergonomic pillow into a U-shaped configuration 600. Along the first lines 136 and second lines 148 of the pillow, strategic stitches are employed to create the desired shape while maintaining structural integrity. These stitches are carefully executed to ensure durability and resilience in supporting the U-shaped form. The folded U-shaped configuration provides added ergonomic benefits, adapting to different user preferences and usage scenarios. For example, the U-shape configuration 600 is used on airplanes or other situations where users need additional neck support.

Achieving the folded U-shaped configuration depicted in FIG. 6, in some embodiments, involves the application of specific stitching techniques. Throughout the first lines 136 and second lines 148 of the pillow, in some embodiments, an overlock stitch is employed. In some embodiments, the overlock stitch not only reinforces the fabric edges but also serves to prevent fraying, contributing to the overall durability of the U-shaped configuration 600. In some embodiments, to fortify areas experiencing tension during the folding process, double stitching is implemented, which involves the sewing of parallel lines for added support.

In some embodiments, before finalizing the permanent stitches, a basting stitch is used for temporary assembly in the U-shaped configuration 600. The basting stitch allows for adjustments, ensuring proper alignment before the application of permanent stitches. In some embodiments, in critical junctures where stability is paramount, lockstitching is employed. Lockstitching involves interlocking threads on the upper and lower sides of the fabric, creating a secure and durable bond resistant to unraveling. In visible areas of the U-shaped configuration 600, in some embodiments, topstitching is applied for both aesthetic appeal and additional reinforcement. Running parallel to the seams, topstitching provides a polished finish while contributing to the overall strength of the folded structure. The combination of these specific stitching techniques ensures a transformation of the unfolded adjustable support pillow into the folded U-shaped configuration 600, maintaining shape, withstanding repeated use, and offering support in various positions.

Figure 7:
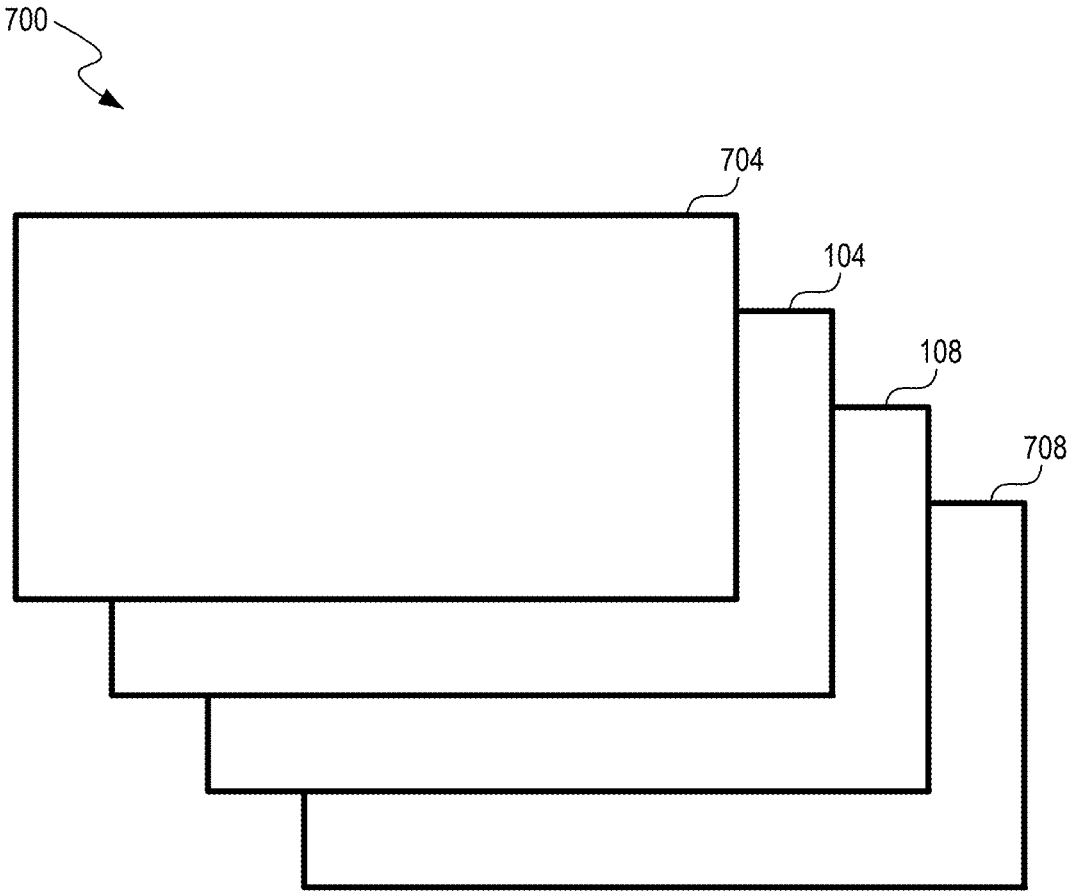
FIG. 7 is a drawing illustrating a layered view of an ergonomic pillow with adjustable support with an outer layer, in accordance with one or more embodiments.

FIG. 7 is a drawing illustrating a layered view of an ergonomic pillow with adjustable support with an outer layer 700, in accordance with one or more embodiments. The outer layer 700 allows users to customize the feel and functionality of the pillow. In some embodiments, the outer layer 700 is crafted among various materials, such as cotton, polyester, linen, bamboo, silk, microfiber, satin, or other suitable fabrics. The choice of material for the outer layer 700, in some embodiments, impacts the pillow's texture, breathability, and overall aesthetics. In some embodiments, the outer layer 700 is made of any of: 1) lyocell Tencel 2) organic cotton 3) bamboo, any combination of these three materials, or any other suitable material having soft, natural, and environmentally sustainable properties. A top layer 704 is placed on top of the first fabric sheet 104, and the bottom layer 708 is placed under the second fabric sheet 108. In some embodiments, the top layer 704 and the bottom layer 708 are both defined by the same dimensions (e.g., length and width). In some embodiments, the dimensions of the top layer 704 and the bottom layer 708 are of a greater length and/or width than the dimensions of both the first fabric sheet 104 and the second fabric sheet 108.

In some embodiments, a zipper system is incorporated to attach the outer layer 700 to the pillow, allowing users to easily remove and replace the outer layer for cleaning or customization. Alternatively, in some embodiments, the outer layer employs a slip-on design, akin to a pillowcase, providing an efficient method to add or remove the outer layer. The selection of attachment methods ensures flexibility in maintaining the pillow's cleanliness and adapting to changing preferences without compromising on convenience. Additionally, in some embodiments, the outer layer 700 introduces additional features, such as cooling or moisture-wicking properties to ensure a dry pillow.

Figure 8:
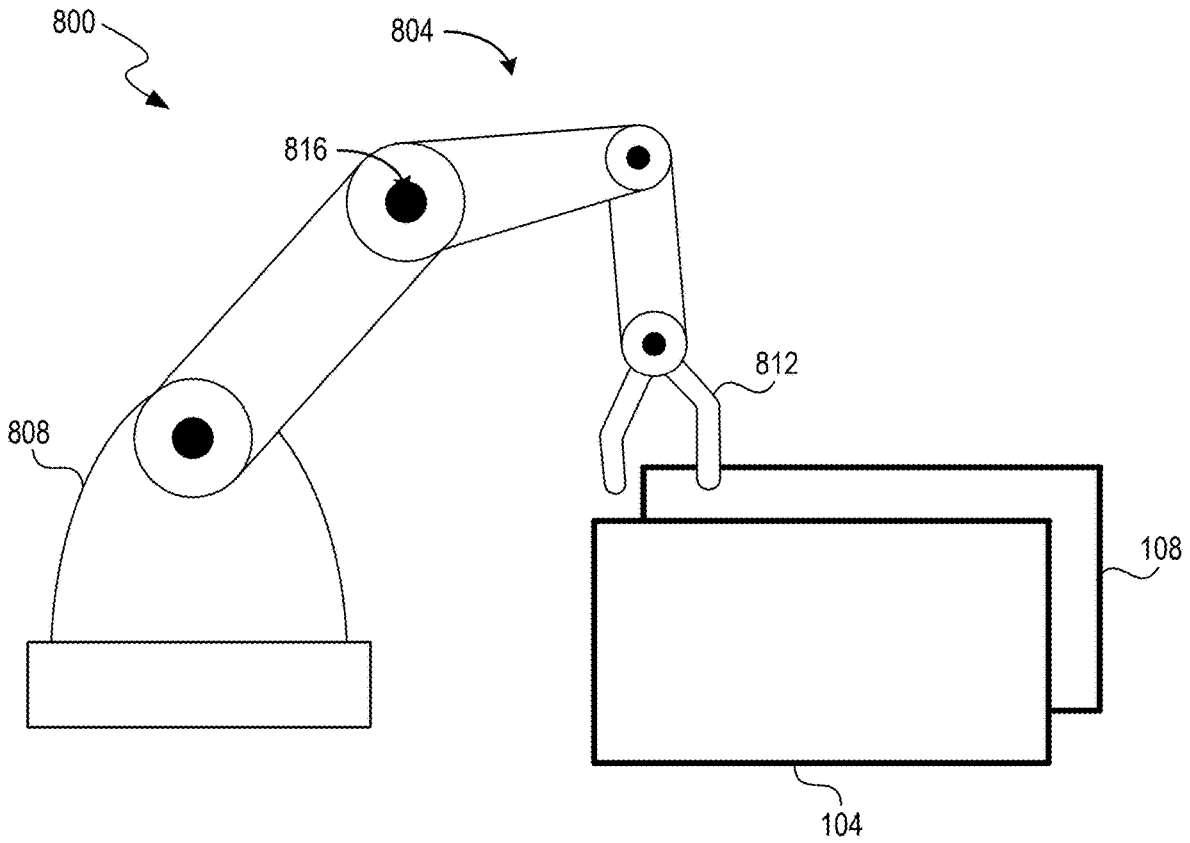
FIG. 8 is a drawing illustrating a method of manufacturing an ergonomic pillow with adjustable support with a movable mechanical device, in accordance with one or more embodiments.

FIG. 8 is a drawing illustrating a method 800 of manufacturing an ergonomic pillow with adjustable support with a movable mechanical device, in accordance with one or more embodiments. In some embodiments, a movable mechanical device is configured to ensure accuracy and repeatability in the assembly of the ergonomic pillow with adjustable support.

In some embodiments, the movable mechanical device comprises arms 804 attached to a base 808, forming a flexible and programmable configuration. Each arm is equipped with clamps 812 that are designed for a secure grip on the first fabric sheet 104. The clamps 812 are configured to provide a reliable hold on the fabric and prevent any slippage or misalignment during the assembly process. In some embodiments, programming the movable mechanical device involves specifying the exact placement of the first fabric sheet 104 on the second fabric sheet 108 according to the predetermined design and pattern.

In some embodiments, the movable mechanical device includes physical or structural members (e.g., arms 804) connected at joints 816 for motion (e.g., rotational and/or translational displacements). The structural members and the joints 816 form a kinetic chain configured to manipulate an end-effector (e.g., clamps 812) configured to execute one or more tasks (e.g., gripping, spinning, or welding) depending on the use/operation of the movable mechanical device. The movable mechanical device, in some embodiments, includes actuation devices (e.g., motors, actuators, wires, artificial muscles, or electroactive polymers) configured to drive or manipulate (e.g., displace and/or reorient) the structural members about or at a corresponding joint 816. For example, the actuation devices and transport motors are connected to or part of the arms 804, a linear slide, or other robotic component.

In some embodiments, the arms 804 are integrated with sensors and actuators, allowing real-time adjustments based on the dimensions and characteristics of the fabric sheets. In some embodiments, the movable mechanical device employs computer vision technology to analyze the position and orientation of the fabric sheets, enabling the robot arms to make dynamic and accurate movements. For example, in some embodiments, the system relies on high-precision sensors, such as encoders and cameras, to detect the exact position, orientation, and dimensions of fabric sheets 104 and 108 in real-time. The sensors detect nearby objects without contacting, moving, or dislodging objects in front of the movable mechanical device.

The sensors, in some embodiments, are configured to obtain information used to implement the tasks, such as for manipulating the structural members and/or for transporting the robotic units. The sensors, in some embodiments, include devices configured to detect or measure one or more physical properties of the robotic system (e.g., a state, a condition, and/or a location of one or more structural members/joints thereof) and/or for a surrounding environment. Some examples of sensors include contact sensors, proximity sensors, accelerometers, gyroscopes, force sensors, strain gauges, torque sensors, position encoders, pressure sensors, vacuum sensors, etc.

In some embodiments, for example, the sensors include one or more imaging devices (not shown) (e.g., 2-dimensional and/or 3-dimensional imaging devices). configured to detect the surrounding environment. The imaging devices, in some embodiments, include cameras (including visual and/or infrared cameras), lidar devices, radar devices, and/or other distance-measuring or detecting devices. The imaging devices generate a representation of the detected environment, such as a digital image and/or a point cloud, used for implementing machine/computer vision (e.g., for automatic inspection, robot guidance, or other robotic applications).

In some embodiments, the software controlling the movable mechanical device includes a combination of motion planning algorithms, computer vision algorithms, and control systems. The Arms 804 position the clamps 812 above the first fabric sheet 104. The arms 804 then cause the clamps 812 to pick up the first fabric sheet 104. The motion planning algorithms then determine the optimal path and movements for arms 804 to follow, ensuring that the first fabric sheet 104 is placed accurately on the second fabric sheet 108. Computer vision algorithms analyze visual data from cameras to identify key features and landmarks on fabric sheets 104 and 108, aiding in precise alignment. The control system manages the coordination and synchronization of the arms 804. In some embodiments, the control system involves closed-loop control mechanisms, where feedback from sensors is continuously used to adjust the movements of the robot arms in real-time. In some embodiments, the software interface used for programming the robot arm system includes a combination of graphical programming tools, scripting languages, and machine learning algorithms. For example, in some embodiments, users input specific parameters, such as the dimensions of the fabric sheets 104 and 108 and the desired alignment, into the software to generate the necessary code for the robot arm system.

Figure 9:
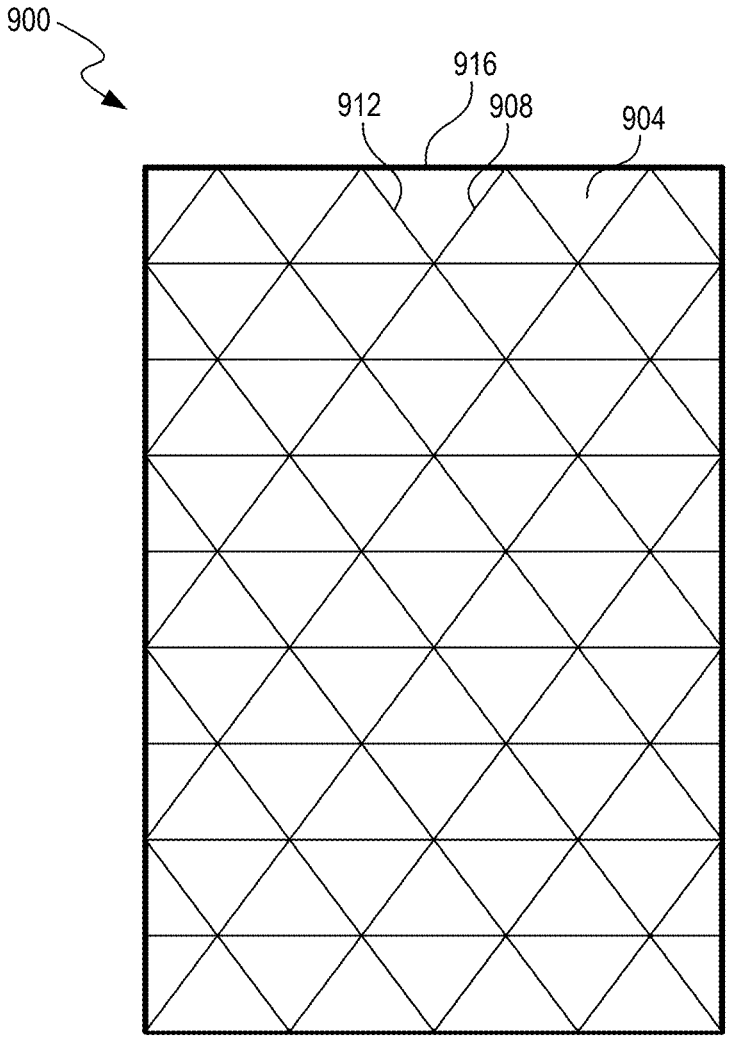
FIG. 9 is a drawing illustrating a top view of an ergonomic pillow with adjustable support with triangle pockets, in accordance with one or more embodiments.

FIG. 9 is a drawing illustrating a top view of an ergonomic pillow 900 with adjustable support with triangle pockets 904, in accordance with one or more embodiments. The triangular pockets 904 are systematically arranged on the first fabric sheet 104. Each triangle pocket 904 is formed by the intersection of grid lines or stitching along the sides 908, 912, and 916. The area within each triangular pocket 904 is configured to accommodate filling material, ensuring a uniform distribution throughout the pillow. The triangular shape introduces variations in pocket sizes compared to the rectangular pockets, offering different levels of support in specific regions of the pillow. In some embodiments, to create the triangular pockets, the sewing process involves following the marked grid lines or outlines of the triangular shape on the fabric. A sewing machine or serger is programmed to execute precise stitching along these marked lines, ensuring accurate alignment and consistent pocket formation. The stitching process, in some embodiments, involves an overlock stitch or other suitable techniques to enhance seam durability.

In some embodiments, the corners, where the sides of the triangles meet, require reinforcement to avoid any potential weak points in the structure. In some embodiments, reinforcement stitches or additional stitching patterns at the corners are employed to fortify the junctions. In some embodiments, the fabric edges surrounding the triangular pockets 904 undergo finishing treatments to prevent fraying and enhance the overall durability of the pillow. Techniques such as serging or hemming are applied to secure the edges.

Figure 10:
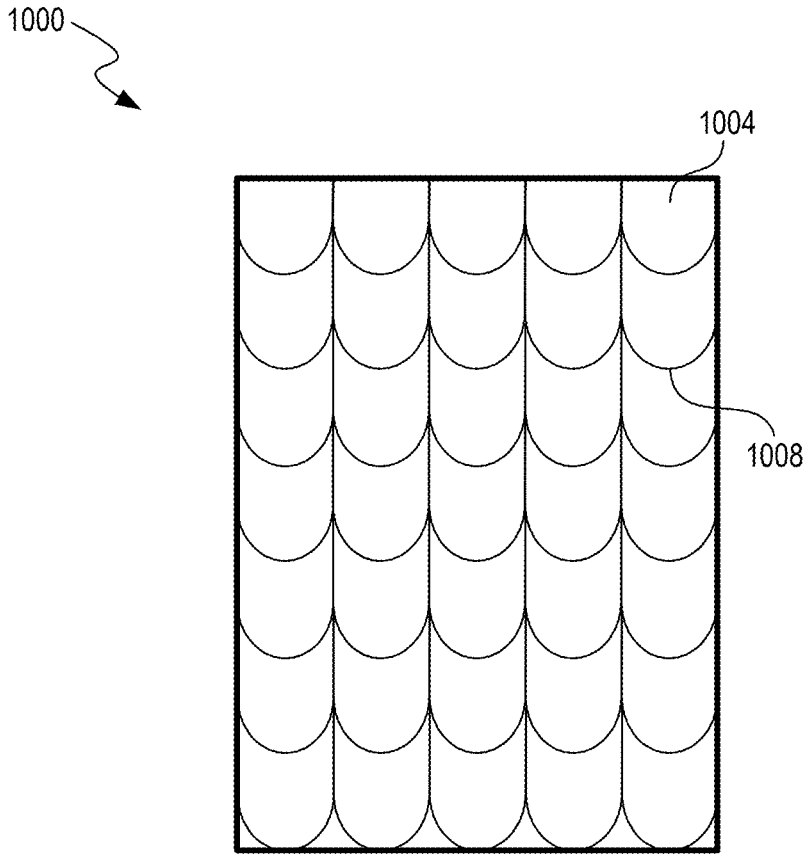
FIG. 10 is a drawing illustrating a top view of an ergonomic pillow with adjustable support with rounded pockets, in accordance with one or more embodiments.

FIG. 10 is a drawing illustrating a top view of an ergonomic pillow 1000 with adjustable support with rounded pockets, in accordance with one or more embodiments.

To create the rounded pockets 1004, a sewing machine or serger is precisely programmed to follow the outlined curves marked on the first fabric sheet 104. The sewing machine, in some embodiments, utilizes specific stitch patterns conducive to the creation of smooth, rounded edges, ensuring that each rounded pocket 1004 is seamlessly formed.

Creating the rounded edges 1008 requires, in some embodiments, the transition from the rounded pocket 1004 to the surrounding fabric to use zigzag stitches or other forms of reinforcement to ensure that the rounded edges are securely fastened and resistant to wear. In addition to the stitching process, in some embodiments, the rounded edges 1008 surrounding the rounded pockets utilize overlocking, serging, or hemming to secure the fabric, preventing fraying and contributing to the overall durability of the pillow.

In some embodiments, a curved needle is employed, allowing for precise manipulation of the stitch path. The needle is threaded in a series of loops and stitches, adjusting tension as needed to maintain consistency. The process involves a combination of running stitches and backstitches placed to form the rounded edges of the pocket.

Figure 11:
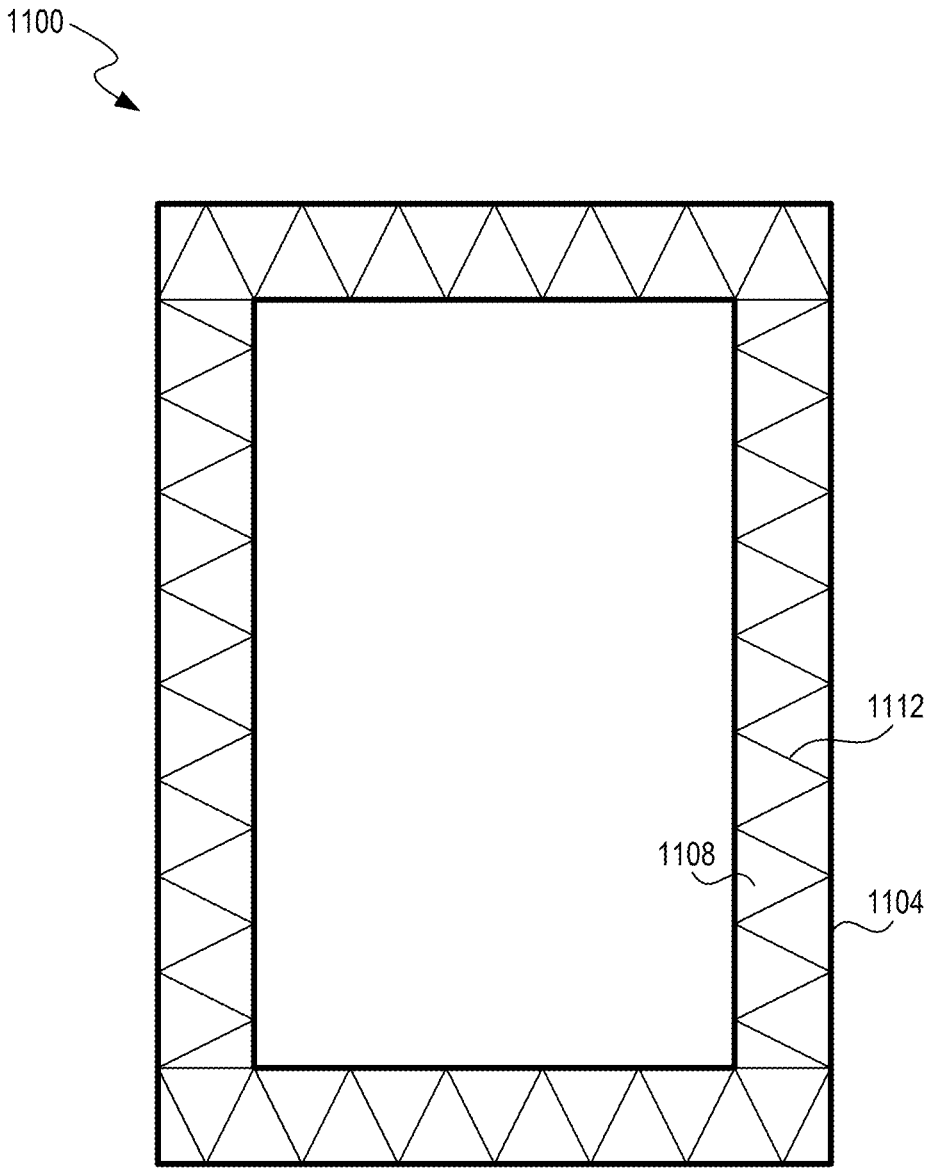
FIG. 11 is a drawing illustrating a method of manufacturing an ergonomic pillow with adjustable support with an overlock stitch, in accordance with one or more embodiments.

FIG. 11 is a drawing illustrating a method 1100 of manufacturing an ergonomic pillow with adjustable support with an overlock stitch, in accordance with one or more embodiments.

The process begins with the fabric sheet, which forms the outer boundary 1104 of the triangular shape. An overlock stitch, also known as a serger stitch, in some embodiments, is applied along the outer boundary 1104. In some embodiments, the overlock stitch serves a dual purpose—it neatly finishes the edge of the fabric, preventing fraying, and securely binds the threaded sides 1108, to reinforce the triangular shape.

The threaded sides 1108 are interwoven through the fabric sheet using a sewing device, creating a secure and durable seam that complements the overall design. The triangular shape denoted by 1112 is formed through the application of the overlock stitch, in some embodiments. In some embodiments, the overlock stitch is part of a larger pattern or a specific design choice tailored to enhance the aesthetic appeal of the adjustable support pillow.

Figure 12:
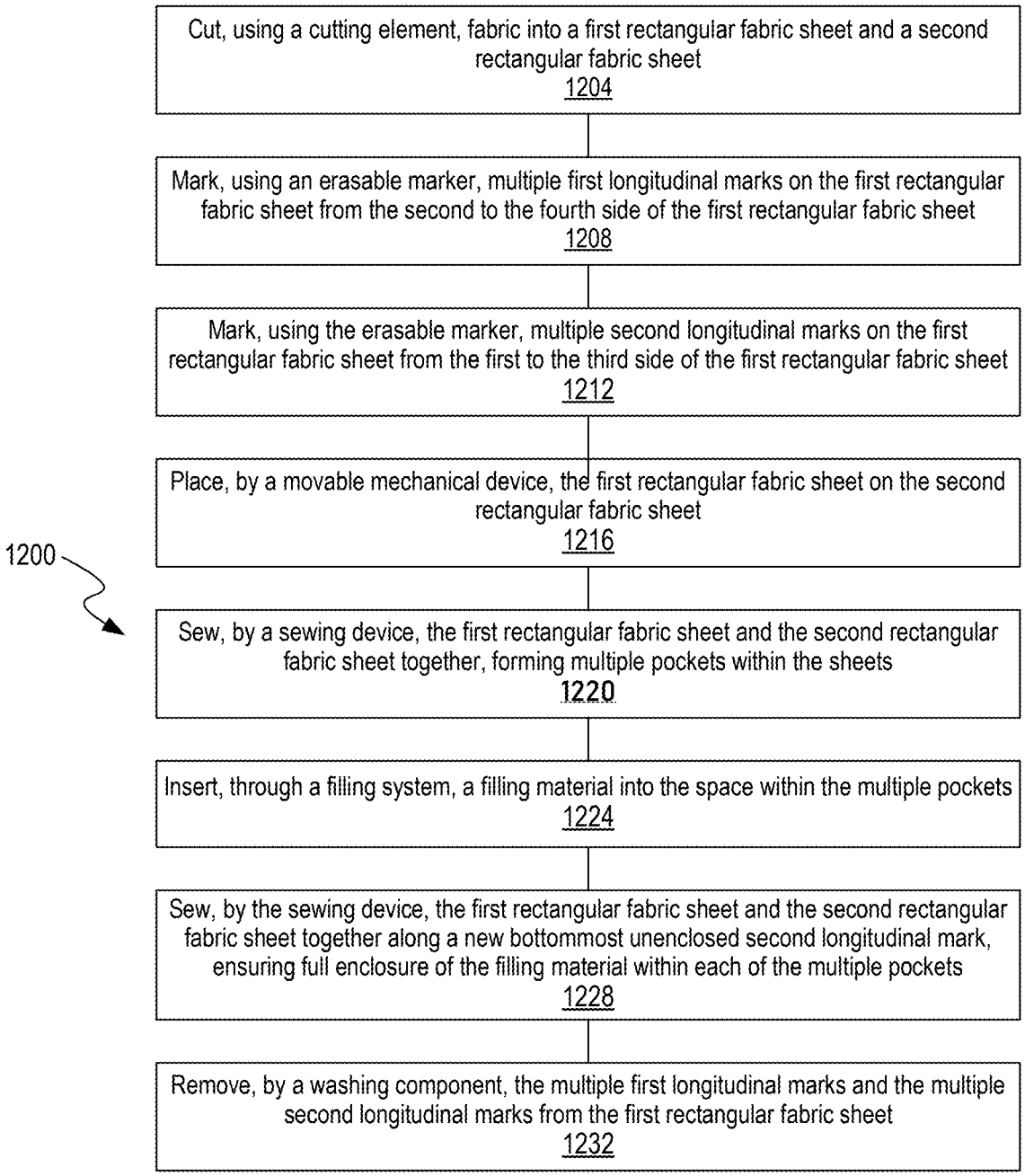
FIG. 12 is a flowchart illustrating a method of manufacturing an ergonomic pillow with adjustable support, in accordance with one or more embodiments.

FIG. 12 is a flowchart illustrating a method 1200 of manufacturing an ergonomic pillow with adjustable support, in accordance with one or more embodiments.

The method 1200 commences at step 1204, where a cutting element is employed to intricately shape the fabric into a first rectangular fabric sheet and a second rectangular fabric sheet. In some embodiments, step 1204 ensures that the fabric sheets are cut into the desired predetermined dimensions.

In steps 1208 and 1212, an erasable marker is utilized to mark multiple first and second longitudinal lines on the first rectangular fabric sheet. These marks serve as reference points for subsequent steps. In some embodiments, the marks are uniformly spaced out. The first longitudinal lines are spaced out equidistantly by a first line distance, except the first and last line of the longitudinal lines closest to the edges of the first longitudinal lines. The first and last lines of the first longitudinal lines are spaced by a first edge distance. Similarly, the second longitudinal lines are drawn. The second longitudinal lines are spaced out equidistantly by a second longitudinal line distance 152, except the first and last line of the second longitudinal lines closest to the edges of the second longitudinal lines. The first and last lines of the second longitudinal lines are spaced by a second edge distance.

At step 1216, a sophisticated movable mechanical device, such as a robotic arm equipped with clamps or a similar mechanism, comes into play. The movable mechanical device places the first rectangular fabric sheet onto the second rectangular fabric sheet, ensuring accuracy and repeatability.

Step 1220 utilizes the sewing device, programmed to execute stitching patterns, following the marked longitudinal lines with precision. The stitching process not only joins the fabric sheets but also forms multiple pockets within the sheets, each following the grid pattern defined by the longitudinal lines.

Step 1224 employs the filling system, where a PVC pipe and funnel arrangement is used. A cutting-edge electric mill grinder transforms the filling material into particles, contributing to optimal consistency. The filling material is then systematically pushed through the funnel and PVC pipe into each pocket using a dowel. Stitching is once again employed at step 1228 to secure the filled pockets, employing a new bottommost unenclosed second longitudinal mark for an enhanced enclosure.

At step 1232, a washing component employs cleaning solutions, such as water-based cleaning solutions, to remove the erasable marker marks from the fabric, contributing to the pillow's aesthetic refinement.

Figure 13:
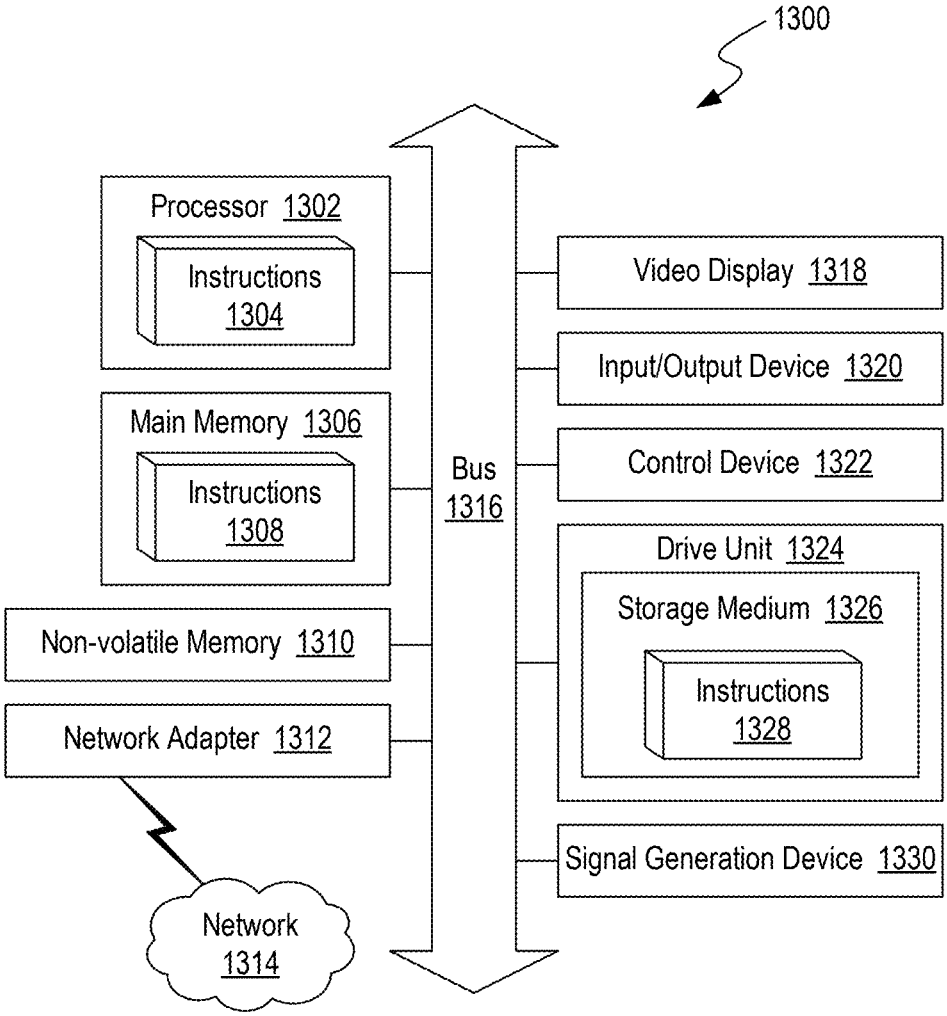
FIG. 13 is a block diagram illustrating an example computer system, in accordance with one or more embodiments.

FIG. 13 is a block diagram illustrating an example computer system, in accordance with one or more embodiments. In some embodiments, components of the example computer system 1300 are used to implement the ML system 1200 illustrated and described in more detail with reference to FIG. 12. At least some operations described herein can be implemented on the computer system 1300.

The computer system 1300 can include one or more central processing units ("processors") 1302, main memory 1306, non-volatile memory 1310, network adapters 1312 (e.g., network interface), video displays 1318, input/output devices 1320, control devices 1322 (e.g., keyboard and pointing devices), drive units 1324 including a storage medium 1326, and a signal generation device 1320 that are communicatively connected to a bus 1316. The bus 1316 is illustrated as an abstraction that represents one or more physical buses and/or point-to-point connections that are connected by appropriate bridges, adapters, or controllers. The bus 1316, therefore, can include a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus (also referred to as "Firewire").

The computer system 1300 can share a similar computer processor architecture as that of a desktop computer, tablet computer, personal digital assistant (PDA), mobile phone, game console, music player, wearable electronic device (e.g., a watch or fitness tracker), network-connected ("smart") device (e.g., a television or home assistant device), virtual/augmented reality systems (e.g., a head-mounted display), or another electronic device capable of executing a set of instructions (sequential or otherwise) that specify action(s) to be taken by the computer system 1300.

While the main memory 1306, non-volatile memory 1310, and storage medium 1326 (also called a "machine-readable medium") are shown to be a single medium, the term "machine-readable medium" and "storage medium" should be taken to include a single medium or multiple media (e.g., a centralized/distributed database and/or associated caches and servers) that store one or more sets of instructions 1328. The term "machine-readable medium" and "storage medium" shall also be taken to include any medium that is capable of storing, encoding, or carrying a set of instructions for execution by the computer system 1300.

In general, the routines executed to implement the embodiments of the disclosure can be implemented as part of an operating system or a specific application, component, program, object, module, or sequence of instructions (collectively referred to as "computer programs"). The computer programs typically include one or more instructions (e.g., instructions 1304, 1308, 1328) set at various times in various memory and storage devices in a computer device. When read and executed by the one or more processors 1302, the instruction(s) cause the computer system 1300 to perform operations to execute elements involving the various aspects of the disclosure.

Moreover, while embodiments have been described in the context of fully functioning computer devices, those skilled in the art will appreciate that the various embodiments are capable of being distributed as a program product in a variety of forms. The disclosure applies regardless of the particular type of machine or computer-readable media used to actually affect the distribution.

Further examples of machine-readable storage media, machine-readable media, or computer-readable media include recordable-type media such as volatile and non-volatile memory devices 1310, floppy and other removable disks, hard disk drives, optical discs (e.g., Compact Disc Read-Only Memory (CD-ROMS), Digital Versatile Discs (DVDs)), and transmission-type media such as digital and analog communication links.

The network adapter 1312 enables the computer system 1300 to mediate data in a network 1314 with an entity that is external to the computer system 1300 through any communication protocol supported by the computer system 1300 and the external entity. The network adapter 1312 can include a network adapter card, a wireless network interface card, a router, an access point, a wireless router, a switch, a multilayer switch, a protocol converter, a gateway, a bridge, a bridge router, a hub, a digital media receiver, and/or a repeater.

The network adapter 1312 can include a firewall that governs and/or manages permission to access proxy data in a computer network and tracks varying levels of trust between different machines and/or applications. The firewall can be any number of modules having any combination of hardware and/or software components able to enforce a predetermined set of access rights between a particular set of machines and applications, machines and machines, and/or applications and applications (e.g., to regulate the flow of traffic and resource sharing between these entities). The firewall can additionally manage and/or have access to an access control list that details permissions including the access and operation rights of an object by an individual, a machine, and/or an application, and the circumstances under which the permission rights stand.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe certain principles and practical applications, thereby enabling others skilled in the relevant art to understand the subject matter, the various embodiments and the various modifications that are suited to the particular uses contemplated.

While embodiments have been described in the context of fully functioning computers and computer systems, those skilled in the art will appreciate that the various embodiments are capable of being distributed as a program product in a variety of forms and that the disclosure applies equally regardless of the particular type of machine- or computer-readable media used to actually effect the distribution.

Although the above Detailed Description describes certain embodiments and the best mode contemplated, no matter how detailed the above appears in text, the embodiments can be practiced in many ways. Details of the systems and methods may vary considerably in their implementation details while still being encompassed by the specification. As noted above, particular terminology used when describing certain features or aspects of various embodiments should not be taken to imply that the terminology is being redefined herein to be restricted to any specific characteristics, features, or aspects of the disclosed technique with which that terminology is associated. In general, the terms used in the following claims should not be construed to limit the disclosure to the specific embodiments disclosed in the specification, unless those terms are explicitly defined herein. Accordingly, the actual scope of the technique encompasses not only the disclosed embodiments but also all equivalent ways of practicing or implementing the embodiments under the claims.

The language used in the specification has been principally selected for readability and instructional purposes, and it may not have been selected to delineate or circumscribe the inventive subject matter. It is therefore intended that the scope of the technique be limited not by this Detailed Description, but rather by any claims that issue on an application based hereon. Accordingly, the disclosure of various embodiments is intended to be illustrative, but not limiting, of the scope of the embodiments, which is set forth in the following claims.

From the foregoing, it will be appreciated that specific embodiments of the invention have been described herein for purposes of illustration, but that various modifications may be made without deviating from the scope of the invention. Accordingly, the invention is not limited except as by the appended claims.

I claim:

1. A method for manufacturing a foldable adjustable support pillow, the method comprising:

cutting, using a cutting element, fabric into a first rectangular fabric sheet and a second rectangular fabric sheet, wherein the first rectangular fabric sheet has a first and a third side having a length, and a second and a fourth side having a width, and wherein the second rectangular fabric sheet is dimensioned in accordance with the length and the width;

marking, using an erasable marker, multiple longitudinal marks on the first rectangular fabric sheet from the second to the fourth side of the first rectangular fabric sheet, wherein each of the multiple longitudinal marks is laterally spaced from each other of the multiple longitudinal marks by a first spacing, and wherein a first and a last one of the multiple longitudinal marks are laterally spaced from the first and the third side of the first rectangular fabric sheet by a second spacing less than the first spacing;

marking, using the erasable marker, multiple transverse marks on the first rectangular fabric sheet from the first to the third side of the first rectangular fabric sheet, wherein each of the multiple transverse marks is laterally spaced from each other of the multiple transverse marks by a third spacing, and wherein a first and a last one of the multiple transverse marks are laterally spaced from the second and the fourth side of the first rectangular fabric sheet by a fourth spacing less than the third spacing;

placing, by a movable mechanical device, the first rectangular fabric sheet on the second rectangular fabric sheet, wherein the multiple longitudinal marks and the multiple transverse marks are exposed;

sewing, by a sewing device, the first rectangular fabric sheet and the second rectangular fabric sheet together, forming multiple pockets within the sheets, wherein the sewing device sews along a bottommost unenclosed transverse mark and also along the multiple longitudinal marks up until the multiple longitudinal marks intersect the bottommost unenclosed transverse mark;

inserting, through a filling system, particles of a filling material into the multiple pockets, wherein to fill each pocket of the multiple pockets, a polyvinyl chloride (PVC) pipe is inserted into the each pocket and a funnel is inserted into the PVC pipe, wherein the particles of the filling material are obtained using a grinding process using an electric mill grinder that grinds the filling material into the particles, and wherein the filling material is pushed through the funnel, and through the PVC pipe, into each of the multiple pockets using a dowel;

sewing, by the sewing device, the first rectangular fabric sheet and the second rectangular fabric sheet together along a new bottommost unenclosed transverse mark, ensuring full enclosure of the filling material within the each pocket of the multiple pockets; and removing, by a washing component, the multiple longitudinal marks and the multiple transverse marks from the first rectangular fabric sheet.

2. The method of claim 1, wherein the filling material includes one or more of: shredded memory foam, cork, cotton, latex, down, polyester fiberfill, or microbeads of polyfoam.

3. The method of claim 1, wherein the first rectangular fabric sheet and the second rectangular fabric sheet comprises a moisture-wicking material, preventing accumulation of moisture.

4. The method of claim 1, wherein one or more of: the first rectangular fabric sheet or the second rectangular fabric sheet are made of at least one of: cotton, polyester, linen, bamboo, silk, microfiber, satin, nylon, spandex, or a nylon/spandex blend.

5. The method of claim 1, wherein the first rectangular fabric sheet and the second rectangular fabric sheet are foldable into a U-shape.

6. The method of claim 1, wherein the particles of the filling material include shredded filling material.

7. The method of claim 1, further comprising:

providing an outer layer, configured to enclose the first rectangular fabric sheet and the second rectangular fabric sheet, made of a cooling and elastic material.

8. A system for manufacturing a foldable adjustable support pillow, the system comprising:

a cutting apparatus configured to cutting fabric into a first rectangular fabric sheet and a second rectangular fabric sheet, wherein the first rectangular fabric sheet has a first and a third side having a length, and a second and a fourth side having a width, and wherein the second rectangular fabric sheet is dimensioned in accordance with the length and the width;

an erasable marker configured to mark multiple longitudinal marks on the first rectangular fabric sheet from the second to the fourth side of the first rectangular fabric sheet, wherein each of the multiple longitudinal marks is laterally spaced from each other of the multiple longitudinal marks by a first spacing, and wherein a first and a last one of the multiple longitudinal marks are laterally spaced from the first and the third side of the first rectangular fabric sheet by a second spacing less than the first spacing;

the erasable marker further configured to mark multiple transverse marks on the first rectangular fabric sheet from the first to the third side of the first rectangular fabric sheet, wherein each of the multiple transverse marks is laterally spaced from each other of the multiple transverse marks by a third spacing, and wherein a first and a last one of the multiple transverse marks are laterally spaced from the second and the fourth side of the first rectangular fabric sheet by a fourth spacing less than the third spacing;

a movable mechanical device to facilitate placing the first rectangular fabric sheet on the second rectangular fabric sheet, wherein the multiple longitudinal marks and the multiple transverse marks are exposed;

a sewing device configured to sew the first rectangular fabric sheet and the second rectangular fabric sheet together, forming multiple pockets within the sheets, wherein the sewing device sews along a bottommost unenclosed transverse mark and also along the multiple longitudinal marks up until the multiple longitudinal marks intersect the bottommost unenclosed transverse mark;

a filling system to insert particles of a filling material into the multiple pockets, wherein to fill each pocket of the multiple pockets, a polyvinyl chloride (PVC) pipe is inserted into the each pocket and a funnel is inserted into the PVC pipe, wherein the particles of the filling material are obtained using a grinding process using an electric mill grinder that grinds the filling material into particles, and wherein the filling material is pushed through the funnel, and through the PVC pipe, into each of the multiple pockets using a dowel;

the sewing device further configured to sew the first rectangular fabric sheet and the second rectangular fabric sheet together along a new bottommost unenclosed transverse mark, ensuring full enclosure of the filling material within the each pocket of the multiple pockets; and a washing component to remove the multiple longitudinal marks and the multiple transverse marks from the first rectangular fabric sheet.

9. The system of claim 8, wherein the cutting apparatus is equipped with computerized controls to cut the first rectangular fabric sheet and the second rectangular fabric sheet.

10. The system of claim 8, wherein the washing component includes a water-based cleaning solution for removal of the multiple longitudinal marks and the multiple transverse marks, and wherein the water-based cleaning solution uses water as a primary solvent to dissolve the multiple longitudinal marks and the multiple transverse marks.

11. The system of claim 8, further comprising a quality control sensor system configured to detect and alert in case of any deviation when sewing along the multiple longitudinal marks or the multiple transverse marks.

12. The system of claim 8, wherein the sewing device is a computerized sewing machine programmed to follow a grid pattern defined by the multiple first and transverse marks.

13. The system of claim 8, wherein the movable mechanical device is a robotic arm, provides accurate and repeatable placement of the first rectangular fabric sheet onto the second rectangular fabric sheet.

* * * * *